US011619387B2

(12) United States Patent
Freeman et al.

(10) Patent No.: US 11,619,387 B2
(45) Date of Patent: Apr. 4, 2023

(54) LINER FOR A COMBUSTOR OF A GAS TURBINE ENGINE WITH METALLIC CORRUGATED MEMBER

(71) Applicants: Rolls-Royce Corporation, Indianapolis, IN (US); Rolls-Royce North American Technologies, Inc., Indianapolis, IN (US)

(72) Inventors: Ted Joseph Freeman, Danville, IN (US); Bruce E. Varney, Greenwood, IN (US); Adam L. Chamberlain, Mooresville, IN (US)

(73) Assignees: Rolls-Royce Corporation, Indianapolis, IN (US); Rolls-Royce North American Technologies Inc., Indianapolis, IN (US)

( * ) Notice: Subject to any disclaimer, the term of this patent is extended or adjusted under 35 U.S.C. 154(b) by 0 days.

(21) Appl. No.: 15/221,373

(22) Filed: Jul. 27, 2016

(65) Prior Publication Data

US 2017/0138596 A1 May 18, 2017

Related U.S. Application Data

(60) Provisional application No. 62/197,869, filed on Jul. 28, 2015.

(51) Int. Cl.

| | |
|---|---|
| ***F23R 3/00*** | (2006.01) |
| ***F23R 3/06*** | (2006.01) |
| ***F23R 3/10*** | (2006.01) |

(52) U.S. Cl.

CPC ..... *F23R 3/002* (2013.01); *F23R 3/007* (2013.01); *F23R 3/06* (2013.01); *F23R 3/10* (2013.01);

(Continued)

(58) Field of Classification Search

CPC ... F02K 1/82; F02K 1/822; F02K 3/08; F02K 3/10; F05D 2250/61; F05D 2250/611;

(Continued)

(56) References Cited

U.S. PATENT DOCUMENTS

| | | | | |
|---|---|---|---|---|
| 3,398,527 A | | 8/1968 | Taylor et al. | |
| 4,315,406 A | * | 2/1982 | Bhangu | F23R 3/002 428/137 |

(Continued)

FOREIGN PATENT DOCUMENTS

| | | | |
|---|---|---|---|
| AU | 1230370 | A | 9/1971 |
| JP | H11101436 | A | 4/1999 |
| NO | 2014201249 | A1 | 12/2014 |

OTHER PUBLICATIONS

European Search Report for Application No. 16181730.9-1602, dated Dec. 19, 2016, 8 pages.

*Primary Examiner* — Stephanie Sebasco Cheng
(74) *Attorney, Agent, or Firm* — Barnes & Thornburg LLP

(57) ABSTRACT

A liner for a combustor includes a support member, an intermediate member, and a liner member. The intermediate member is positioned intermediate the support member and the liner member and has a plurality of protrusions and a plurality of recesses. The support member is coupled to the intermediate member at a tangent of each protrusion. Additionally, the liner member is comprised of a ceramic matrix composite material. The liner member is coupled to the intermediate member at a tangent of each recess.

20 Claims, 4 Drawing Sheets

(52) U.S. Cl.
CPC .... *F05D 2250/61* (2013.01); *F05D 2250/611* (2013.01); *F23R 2900/03041* (2013.01); *F23R 2900/03043* (2013.01); *F23R 2900/03044* (2013.01)

(58) Field of Classification Search
CPC ..... F05D 2250/60; F05D 2300/6033; F23R 2900/00001; F23R 2900/03041; F23R 2900/03042; F23R 2900/03043; F23R 2900/03044; F23R 2900/03045; F23M 5/08; F23M 5/085; F23M 5/04
See application file for complete search history.

(56) References Cited

U.S. PATENT DOCUMENTS 5,333,443 A * 8/1994 Halila ..... F23R 3/002 60/752
5,363,654 A * 11/1994 Lee ..... F28F 13/02 60/752
H1380 H 12/1994 Halila et al.
6,767,659 B1 7/2004 Campbell
7,043,921 B2 5/2006 Hadder
7,546,743 B2 6/2009 Bulman et al.
7,908,867 B2 3/2011 Keller et al.
8,141,364 B2 3/2012 Benoit et al.
8,161,753 B2 4/2012 Benoit et al.
8,202,588 B2 6/2012 Keller et al.
8,549,861 B2 10/2013 Huffman
8,667,801 B2 * 3/2014 Roldan-Posada ..... F01D 9/023 60/39.37
8,727,714 B2 * 5/2014 Snider ..... F23R 3/002 415/178
8,863,527 B2 10/2014 Holcomb et al.
2008/0304959 A1 * 12/2008 Benoit ..... F01D 9/023 415/200
2010/0095679 A1 * 4/2010 Rudrapatna ..... F23R 3/005 60/752
2012/0121381 A1 * 5/2012 Charron ..... F01D 9/023 415/115
2017/0089579 A1 * 3/2017 Bunker ..... F23R 3/007

* cited by examiner

LINER FOR A COMBUSTOR OF A GAS TURBINE ENGINE WITH METALLIC CORRUGATED MEMBER

CROSS-REFERENCE TO RELATED APPLICATIONS

The present application claims the benefit of priority from U.S. Patent Application Ser. No. 62/197,869, filed on Jul. 28, 2015, which is incorporated herein by reference in its entirety.

FIELD OF THE DISCLOSURE

The present disclosure relates to ceramic matrix composite tiles for gas turbine engines.

BACKGROUND OF THE PRESENT DISCLOSURE

Gas turbine engines operate in high-temperature environments. More particularly, a combustor of a gas turbine engine includes a combustion chamber which may experience high temperatures greater than 1,000° F. during the combustion process. As such, components of the combustor, such as a combustor liner, may be comprised of or coated with insulation materials.

By including insulating materials within the combustor liner, other components of the engine may be shielded from the heat produced in the combustion chamber. However, the insulating materials may be exposed to the high temperatures generated in the combustion chamber and further exposed to the forces generated in the combustion chamber during combustion. As such, there is a need to provide a method for both cooling the insulating materials and maintaining the position of the insulating materials during combustion.

SUMMARY OF DISCLOSED EMBODIMENTS OF THE PRESENT DISCLOSURE

In the disclosed embodiments, components of a combustor liner may be comprised of or coated with insulating materials. For example, a portion of the combustor liner may be comprised of ceramic matrix composite ("CMC") materials. Compared to metals, CMC materials have lower thermal conductivities. Therefore, by including a CMC material in or on the liner of the combustor, heat transfer to other components of the combustor and/or the gas turbine engine may be reduced. Additionally, gas passages may be included in the liner to enable air flow therethrough and decrease the temperature thereof during operation of the gas turbine engine.

The liner of the combustor includes insulating materials, such as CMC materials, to shield other components of the liner and/or the engine from the heat generated in the combustion chamber during operation of the engine. Additionally, the intermediate member of the present disclosure is configured to position the CMC materials of the liner to avoid movement of the CMC materials as a result of the forces generated in the combustion chamber during combustion. Further, because the CMC material of the liner is exposed to the high temperatures generated in the combustion chamber, the exemplary intermediate member of the present disclosure also includes gas passages for flowing cooling gases to the CMC material to decrease the temperature thereof.

In one embodiment of the present disclosure, a liner assembly for a combustor comprises a support member, an intermediate member, and a liner member. The intermediate member has a plurality of protrusions and a plurality of recesses. The intermediate member is coupled to the support member at a tangent of each protrusion. The liner member is comprised of a CMC material, is coupled to the intermediate member at a tangent of each recess, and defines a combustion chamber of the combustor. The intermediate member is positioned intermediate the support member and the liner member.

In another embodiment of the present disclosure, a liner assembly for a combustor comprises a support member, an intermediate member, and a liner member. The intermediate member has a first surface facing the support member and a second surface opposite the first surface. The liner member is comprised of a ceramic matrix composite material. The intermediate member is positioned intermediate the support member and the liner member. Additionally, the liner assembly comprises a first gas passage positioned along the first surface of the intermediate member and a second gas passage positioned along the second surface of the intermediate member.

In a further embodiment of the present disclosure, a liner assembly for a combustor comprises a support member including a first plurality of gas passages, an intermediate member including a second plurality of gas passages, and a liner member comprised of a ceramic matrix composite material. The intermediate member is positioned intermediate the support member and the liner member.

Additional embodiments encompass some or all the foregoing features, arranged in any suitable combination. Certain embodiments of the present disclosure may include some, all, or none of the above advantages. One or more other technical advantages may be readily apparent to those skilled in the art from the figures, descriptions, and claims included herein.

The features and advantages of the present disclosure will become more readily appreciable from the following detailed description when taken in conjunction with the accompanying drawings.

BRIEF DESCRIPTION OF THE DRAWINGS

The detailed description of the drawings particularly refers to the accompanying figures in which.

Figure 1:
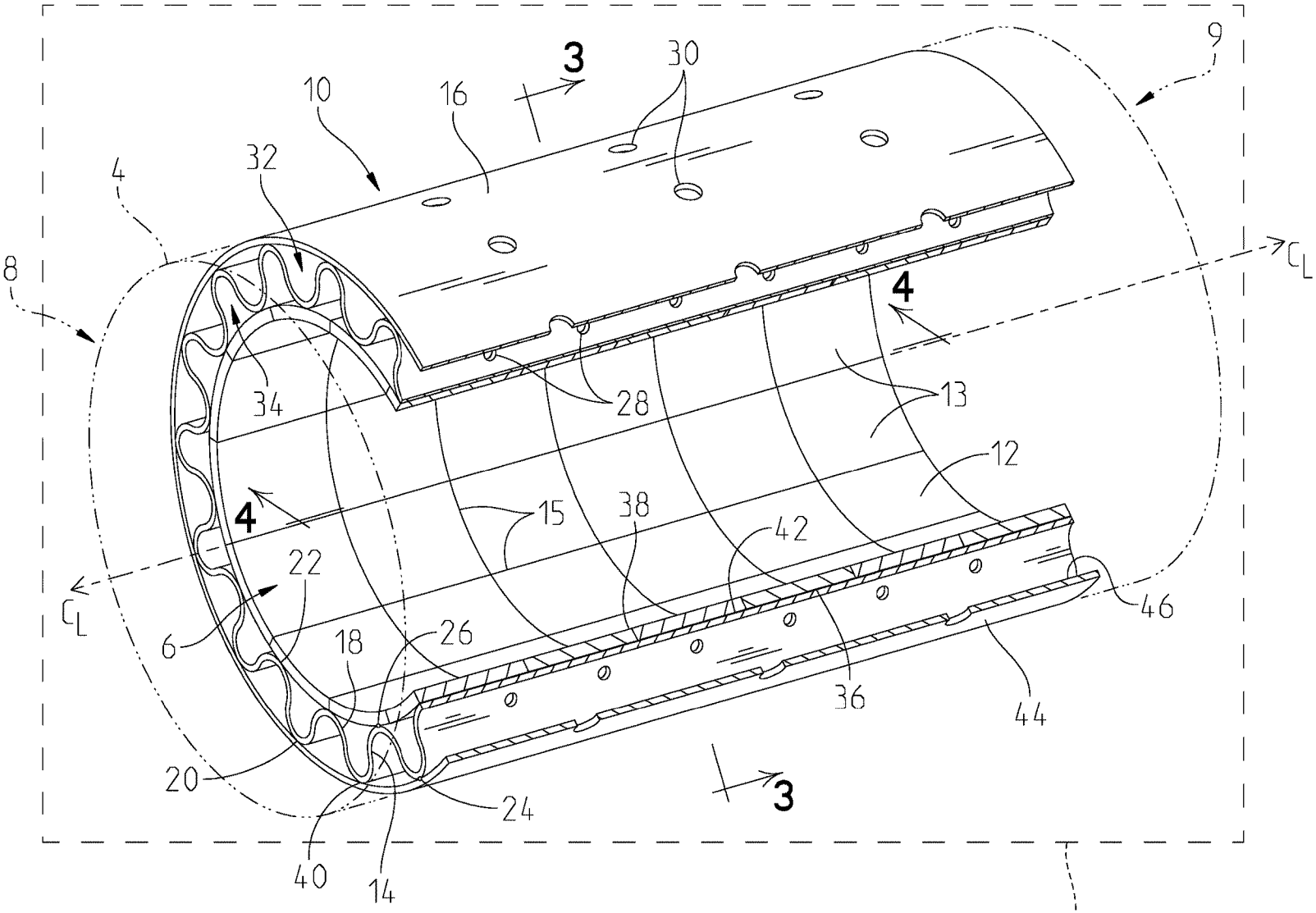
FIG. 1 is a perspective view of an exemplary liner assembly for a combustor of a gas turbine engine of the present disclosure.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the disclosure, and such exemplifications are not to be construed as limiting the scope of the claims in any manner.

DETAILED DESCRIPTION OF THE DRAWINGS

For the purposes of promoting an understanding of the principles of the disclosure, reference will now be made to the embodiments illustrated in the drawings, which are described below. The embodiments of the disclosure described herein are not intended to be exhaustive or to limit the disclosure to precise forms disclosed. Rather, the embodiments are chosen and described so that others skilled in the art may utilize their teachings. It will be understood that no limitation of the scope of the claims is thereby intended unless specifically stated. Except where a contrary intent is expressly stated, terms are used in their singular form for clarity and are intended to include their plural form.

Referring to FIGS. 1-4, a gas turbine engine 2 includes a combustor 4 for combustion therein during operation of engine 2. As shown in FIG. 1, combustor 4 extends longitudinally between a first or fore end 8 and a second or aft end 9. High temperatures are generated within combustor 4 during combustion and, as such, a liner assembly 10 may be provided to insulate other components of engine 2 from the high temperatures of combustor 4. More particularly, at least a portion of liner assembly 10 may be comprised of or coated with an insulating material that reduces heat transfer from combustor 4 to the other components of engine 2 and/or liner assembly 10. Additional details of combustor 4 and/or engine 2 may be disclosed in U.S. Pat. No. 8,863,527, issued on Oct. 21, 2014, and entitled "COMBUSTOR LINER", the complete disclosure of which is expressly incorporated by reference herein.

Figure 2:
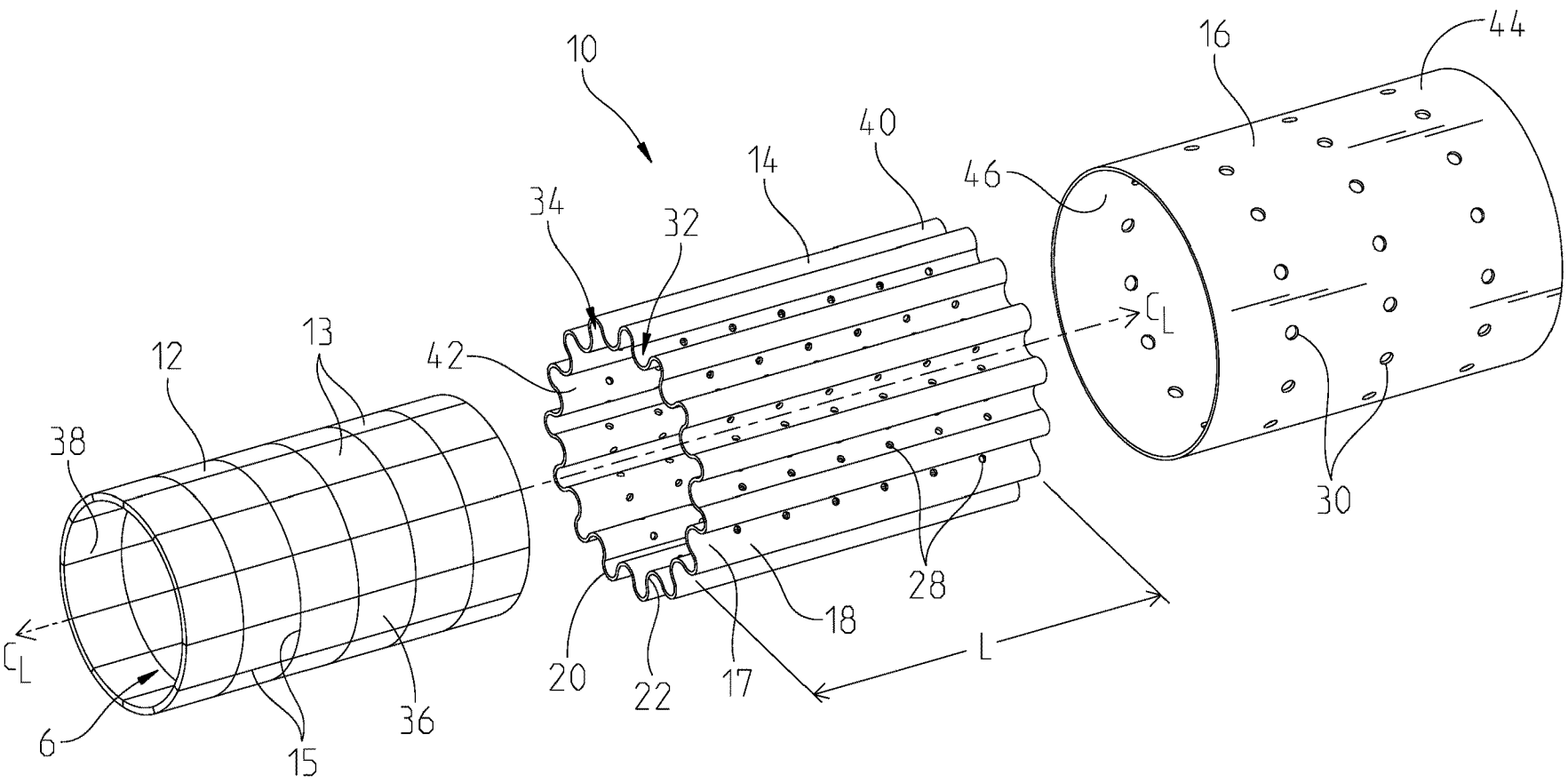
FIG. 2 is an exploded view of the liner assembly of FIG. 1.

As shown in FIG. 2, liner assembly 10 includes a liner member 12, an intermediate member 14, and a support member 16. Liner member 12 is comprised of a plurality of individual tiles 13 and each tile 13 includes an outer surface 36 and inner surface 38. Intermediate member 14 includes outer surface 40 and inner surface 42. Support member 16 includes an outer surface 44 and an inner surface 46. Tiles 13 of liner member 12 collectively are positioned to generally define a cylinder. Similarly, intermediate member 14 and support member 16 are each generally cylindrically shaped and extend along a longitudinal centerline $C_L$ of liner assembly 10. More particularly, intermediate member 14 and support member 16 each may define a continuous hoop or cylinder generally defining a circular shape in cross-section. Intermediate member 14 may be coupled to liner member 12 and support member 16, as disclosed further herein.

Figure 3:
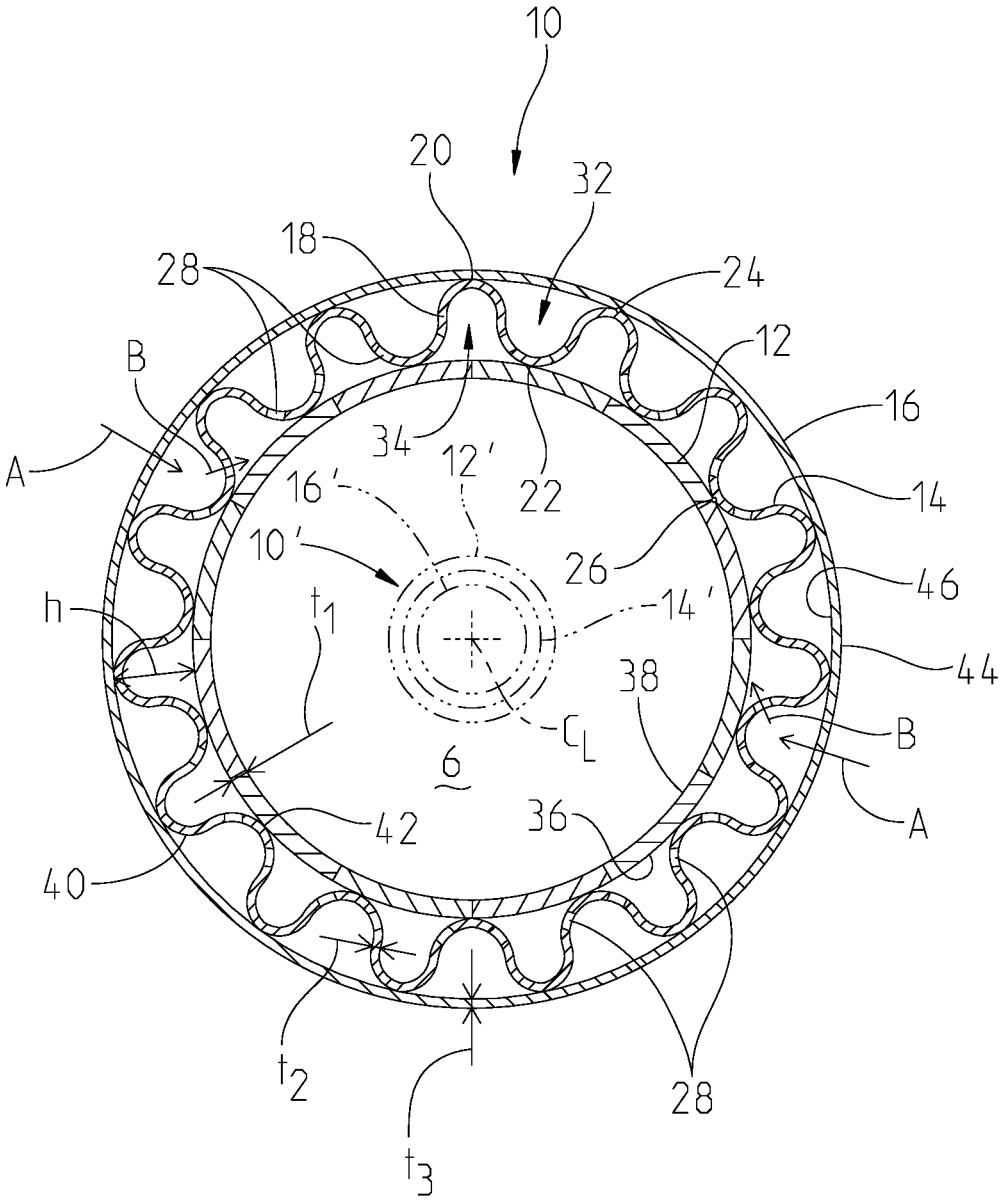
FIG. 3 is a cross-sectional view of the liner assembly of FIG. 1, taken along line 3-3 of FIG. 1.

Combustor 4 also comprises a liner assembly 10', shown in FIG. 3 and omitted from FIGS. 1 and 2 for clarity, disposed within liner assembly 10. A combustion chamber 6 is defined between liner assembly 10 and liner assembly 10'. Liner assembly 10' is configured to receive a shaft (not shown) of engine 2 therethrough and includes components generally identical to the components of liner assembly 10, except having smaller diameters and disposed in reverse order with respect to longitudinal centerline $C_L$. For example, liner assembly 10' includes a support member 16' generally identical to support member 16, an intermediate member 14' generally identical to intermediate member 14, and a liner member 12' generally identical to liner member 12. Liner member 12' is also comprised of a plurality of individual tiles 13, such that combustion chamber 6 is bounded by tiles 13 of liner member 12 and liner member 12'. The structure and function of tiles 13 is described below with reference to liner member 12, however it should be understood that the description of said structure and function applies equally to tiles 13 of support member 12'.

Tiles 13 are positioned adjacent each other but are slightly spaced apart from each other by open passages 15 which define gas passages between each tile 13. As such, tiles 13 of liner member 12 are exposed to high temperatures as a result of the combustion process. To reduce heat transfer from combustion chamber 6 to intermediate member 14, support member 16, and/or other components of engine 2, tiles 13 of liner member 12 may be comprised of or coated with an insulating material. In one embodiment, tiles 13 are comprised of a CMC material. By comprising each tile 13 of a CMC material, combustion within combustion chamber 6 may burn at elevated temperatures without decreasing the integrity of liner member 12 and/or transferring heat from combustion chamber 6 to additional components of engine 2. Additionally, in a further embodiment, inner surface 38 of each tile 13 may be coated with an environmental or thermal barrier coating to protect tiles 13 from byproducts formed during combustion. Illustratively, each tile 13 may have a thickness $t_1$ (FIG. 3) of approximately 0.05 inches, 0.06 inches, 0.07 inches, 0.08 inches, 0.09 inches, 0.10 inches, 0.11 inches, 0.12 inches, 0.13 inches, 0.14 inches, 0.15 inches, 0.16 inches, 0.17 inches, 0.18 inches, 0.19 inches, 0.20 inches, or within any range delimited by any pair of the foregoing values.

CMC materials are frequently comprised of fibers embedded within a ceramic matrix. For example, CMC materials may contain a ceramic material embedded with carbon fibers, silicon carbide fibers, alumina fibers, and/or mullite fibers. The fibers may be provided in any configuration, such as a fiber fabric, filament winding(s), braiding, and/or knotting or any other configuration known to those skilled in the art.

Referring to FIGS. 2 and 3, intermediate member 14 is positioned radially outwardly (relative to $C_L$) from liner member 12. Intermediate member 14 may be comprised of a metallic, polymeric, and/or ceramic material. In one embodiment, intermediate member 14 is comprised of a metallic material and, illustratively, is comprised of a corrugated metallic material. More particularly, intermediate member 14 may be comprised of a wrought, high-temperature nickel or cobalt-based alloy. By wrought it is meant that the material is worked into shape. For example, the material may be rolled to form corrugations. Alternatively, intermediate member 14 may be made by a casting process and thus be comprised of a cast, high-temperature nickel or cobalt-based alloy, with corrugations. Thus, the presence of corrugations is not indicative of a particular construction process. As shown in FIGS. 1-3, intermediate member 14 includes a continuously corrugated wall 17 with a plurality of radial extensions or corrugations 18 with a length L (FIG. 2) extending generally parallel to centerline $C_L$. Alternatively, extensions 18 may be in a generally perpendicular orientation to that shown in FIGS. 1-3 such that length L of extensions 18 extends generally circumferentially around centerline $C_L$. Length L of extensions 18 is substantially greater than a height h (FIG. 3) and a thickness $t_2$ (FIG. 3) of extensions 18. The number of extensions 18 also may vary to accommodate various sizes and applications of liner assembly 10. Thickness $t_2$ (FIG. 3) of extensions 18 may be approximately 0.01 inches, 0.02 inches, 0.03 inches, 0.04 inches, 0.05 inches, 0.06 inches, 0.07 inches, 0.08 inches, 0.09 inches, 0.10 inches, 0.15 inches, 0.2 inches or within any range delimited by any pair of the foregoing values.

Referring to FIGS. 1-3, the radially outermost outer ends of extensions 18 include peaks or protrusions 20 adjacent support member 16 and the inner ends of extensions 18 include valleys or recesses 22 adjacent liner member 12. Protrusions 20 and recesses 22 may be rounded or have a semi-curved shape relative to extensions 18 such that each protrusion 20 has a tangent point 24 and each recess 22 has a tangent point 26. As shown in FIGS. 2 and 3, protrusions 20 and recesses 22 may be joined to each other through extensions 18 to generally define a wave configuration of intermediate member 14. Alternatively, intermediate member 14 may have a different configuration, such as a honeycomb configuration or any other configuration with a plurality of protrusions adjacent support member 16 and a plurality of recesses adjacent liner member 12. Height h (FIG. 3) of intermediate member 14 extends perpendicularly to centerline $C_L$ and between tangent points 24, 26 and may be 0.050 inches, 0.075 inches, 0.100 inches, 0.125 inches, 0.150 inches, 0.175 inches, 0.200 inches, 0.225 inches, 0.250 inches, 0.275 inches, 0.300 inches, 0.325 inches, 0.350 inches, 0.375 inches, 0.400 inches or within any range delimited by any pair of the foregoing values.

In one embodiment, and as shown in FIGS. 1 and 3, intermediate member 14 may be coupled to each tile 13 of liner member 12 at tangent points 26 and to support member 16 at tangent points 24 through surface coupling. For example, recesses 22 and protrusions 20 of intermediate member 14 may be coupled to tiles 13 of liner member 12 and support member 16, respectively, with spot or tack welding, brazing, bonding, adhesives, and/or mechanical fasteners at respective tangent points 26 and 24. As such, the inner surface of intermediate member 14 is not coupled in its entirety to outer surface 36 of each tile 13 and outer surface 40 of intermediate member 14 is not coupled in its entirety to the inner surface of support member 16. In one embodiment, only a portion of protrusions 20 and recesses 22 are coupled to support member 16 and tiles 13, respectively. For example, every other protrusion 20 and every other recess 22 may be coupled to support member 16 and tiles 13, respectively.

By coupling intermediate member 14 to tiles 13, intermediate member 14 secures tiles 13 to support member 16 and positions tiles 13, which decreases the likelihood that tiles 13 will move axially or circumferentially in response to the combustion process within combustion chamber 6. Intermediate member 14 also may increase the structural rigidity of liner assembly 10 of combustor 4 because support member 16 is coupled to tiles 13 through intermediate member 14. In an alternative embodiment, intermediate member 14 may not be coupled to support member 16 and/or liner member 12 such that intermediate member 14 is maintained between inner and support members 12, 16 through an interference fit.

As shown in FIGS. 1-4, intermediate member 14 includes a plurality of apertures 28. In one embodiment, apertures 28 extend through a portion of extensions 18 between protrusions 20 and recesses 22. As such, the portion of intermediate member 14 which includes apertures 28 is spaced apart from liner and support members 12, 16 such that the portion of intermediate member 14 which includes apertures 28 does not abut liner and support members 12, 16. In one embodiment, apertures 28 on each extension 18 of intermediate member 14 are located along a generally longitudinal line parallel to centerline $C_L$. The number, size, and pattern of apertures 28 may vary to accommodate various liner assemblies 10. In one embodiment, apertures 28 may have a diameter of approximately 0.02 inches, 0.025 inches, 0.030 inches, 0.035 inches, 0.040 inches, 0.045 inches, 0.050 inches or within any range delimited by any pair of the foregoing values. Apertures 28 may be machined, stamped, drilled, or otherwise applied to intermediate member 14 and may be applied to intermediate member 14 before or after protrusions 20 and recesses 22 are formed therein.

Referring to FIGS. 1 and 3, support member 16 is positioned outwardly of intermediate member 14 and, as disclosed herein, is coupled at tangent points 24 of protrusions 20 of intermediate member 14. Support member 16 may be comprised of a metallic, polymeric, and/or ceramic material. Illustratively, support member 16 is comprised of a metallic material. Support member 16 is a structural component of liner assembly 10 and is configured to receive additional components of engine 2. For example, mechanical fasteners (not shown) may be applied to support member 16 for coupling with other components of engine 2 or other structure.

Figure 4:
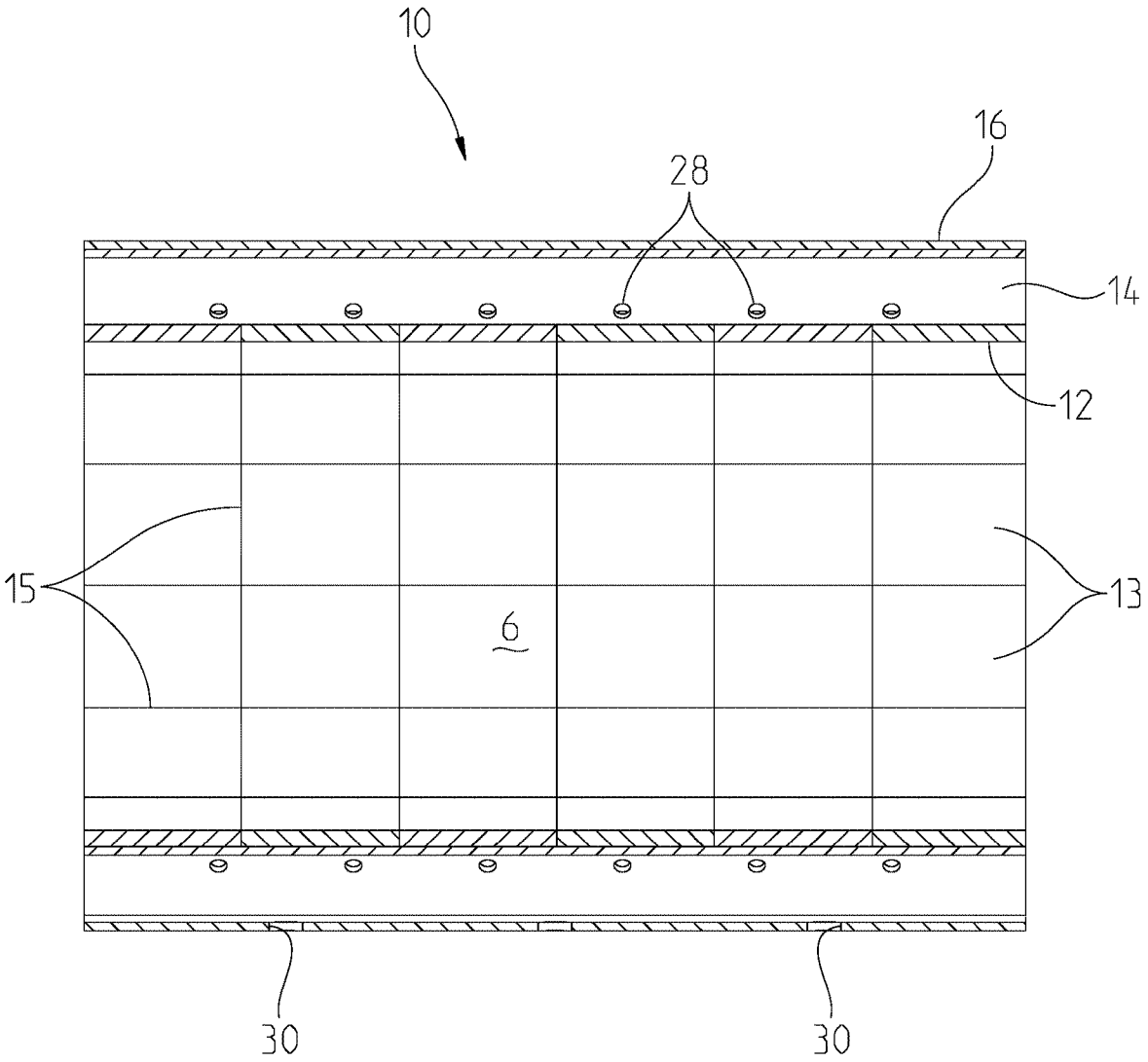
FIG. 4 is a cross-sectional view of the liner assembly of FIG. 1, taken along line 4-4 of FIG. 1.

Referring to FIGS. 1-3, as with intermediate member 14, support member 16 also includes a plurality of apertures 30 extending through a thickness $t_3$ of support member 16. In one embodiment, thickness $t_3$ of support member 16 may be approximately 0.01 inches, 0.02 inches, 0.03 inches, 0.04 inches, 0.05 inches, 0.06 inches, 0.07 inches, 0.08 inches, 0.09 inches, 0.10 inches, 0.15 inches, 0.2 inches or within any range delimited by any pair of the foregoing values. Apertures 30 may be machined, drilled, stamped, or otherwise applied to support member 16. In one embodiment, apertures 30 are located along generally longitudinal lines parallel to centerline $C_L$. The number, size, and pattern of apertures 30 may vary to accommodate various liner assemblies 10. In one embodiment, apertures 30 may have a diameter of approximately 0.050 inches, 0.075 inches, 0.100 inches, 0.125 inches, 0.150 inches, 0.175 inches, 0.200 inches, 0.225 inches, 0.250 inches, 0.275 inches, 0.300 inches or within any range delimited by any pair of the foregoing values. Illustratively, apertures 30 have a larger diameter than apertures 28, however, in alternative embodiments of liner assembly 10, apertures 30 may have a smaller diameter than that of apertures 28. Additionally, as shown in FIGS. 1 and 4, apertures 28 may be longitudinally offset from apertures 30 such that apertures 28 and 30 are not aligned with each other. Alternatively, apertures 28 and 30 may be aligned with each other.

Because tiles 13 of liner member 12 experience high temperatures during combustion within combustion chamber 6, cooling gas (e.g., air) may be provided along outer surface 36 of each tile 13 to decrease the temperature of liner member 12. More particularly, cooling gas may be discharged gas from a compressor (not shown) of engine 2. As shown in FIG. 3, apertures 30 receive cooling gas from the compressor or another source of gas in direction A such that cooling gas flows towards intermediate member 14 to cool intermediate member 14. Illustratively, gas flowing in direction A is received within a first cooling passage 32 defined generally inward of support member 16, between adjacent extensions 18 of intermediate member 14, and generally outward of recesses 22 of intermediate member 14. Direction A may be perpendicular to centerline $C_L$. First cooling passages 32 extend along length L of extensions 18 of intermediate member 14 and may be generally parallel to centerline $C_L$.

As shown in FIG. 3, after gas is received through apertures 30 and into first cooling passages 32, gas flows through apertures 28 of intermediate member 14 in direction B, such that cooling gas flows towards liner member 12 to cool each tile 13. In addition to cooling tiles 13, a portion of the gas flowing in direction B also flows through open passages 15 between each tile 13 and into combustion chamber 6 to facilitate combustion therein. Illustratively, a portion of gas flowing in direction B is received within a second cooling passage 34 defined generally inward of support member 16, between adjacent extensions 18 of intermediate member 14, and generally inward of protrusions 20 of intermediate member 14. Additionally, at least a portion of the gas flowing in direction B flows through open passages 15 and into combustion chamber 6. Direction B may be angled relative to direction A because apertures 28, 30 are longitudinally offset from each other. As such, the gas flowing through apertures 30 bends or angles towards apertures 28 to flow therethrough for cooling liner member 12 and facilitating combustion within combustion chamber 6. More particularly, because tiles 13 are comprised of a CMC material, which has increased heat transfer resistance, less cooling gas may be needed to cool liner member 12 such that more of the gas flowing in direction B may be directed into combustion chamber 6 to increase combustion therein.

Referring to FIG. 2, second cooling passages 34 extend along length L of extensions 18 of intermediate member 14 and may be generally parallel to centerline $C_L$. Additionally, second cooling passages 34 are positioned adjacent first cooling passages 32 such that first and second cooling passages 32, 34 are alternately positioned around intermediate member 14 and extend parallel to each other. As shown in FIGS. 1-4, gas flowing through first and second cooling passages 32, 34 flows generally parallel to centerline $C_L$. Alternatively, if the orientation of wall 17 is perpendicular to that shown in FIGS. 1-4, such that extensions 18 may be rotated to be annular rings about the circumference of intermediate member 14, then the cooling gas flowing in first and second cooling passages 32, 34 would flow in the circumferential direction of liner assembly 10. As such, intermediate member 14 uniformly cools the entire outer surface 36 of liner member 12 by the cooling gases flowing through first and second cooling passages 32, 34. In this way, intermediate member 14 decreases the likelihood that hot spots will develop along liner member 12 but also does not affect the heat distribution within combustion chamber 6. Additionally, intermediate member 14 provides air to combustion chamber 6 through open passages 15.

After gas flows into first cooling passages 32 through apertures 30, gas flows into second cooling passages 34 through apertures 28. As such, the discharged gas provided by the compressor of engine 2 cools both intermediate member 14 and liner member 12 and also flows into combustion chamber 6 for combustion therein. The cooling gas and/or combustion gas then flows out of aft end 9 of combustor 4 through cooling holes (not shown) provided at aft end 9 (FIG. 1).

As shown in FIG. 2, because apertures 28 may have a smaller diameter than that of apertures 30, apertures 28 control the flow of cooling gas towards liner member 12. More particularly, apertures 28 have a smaller flow area than that of apertures 30 because apertures 28 have a smaller diameter than that of apertures 30. In this way, the smaller flow area of apertures 28 controls the flow of gas to liner member 12. Alternatively, if apertures 30 have a smaller diameter than that of apertures 28, then apertures 30 would have the smaller flow area and would control the flow gas to liner member 12.

Additionally, during operation of engine 2, intermediate member 14 may experience high temperatures and, in embodiments where intermediate member 14 is comprised of a metallic material, may expand and contract when heated and cooled, respectively. For example, intermediate member 14 may have a coefficient of thermal expansion approximately 2-4 times greater than the coefficient of thermal expansion of liner member 12. As such, during combustion within combustion chamber 6, the material of intermediate member 14 may expand in response to heat transfer through liner member 12. However, because intermediate member 14 is coupled to liner member 12 and support member 16 at respective tangent points 26, 24, rather than being coupled in entirety to inner and support members 12, 16, intermediate member 14 may expand and contract between inner and support members 12, 16 without experiencing or causing undue stress.

In additional embodiment a liner assembly for a combustor comprises a support member; an intermediate member having a first surface facing the support member and a second surface opposite the first surface; a liner member comprised of a ceramic matrix composite material, wherein the intermediate member is positioned intermediate the support member and the liner member. In one example, the liner assembly further comprises a first gas passage positioned along the first surface of the intermediate member; and a second gas passage positioned along the second surface of the intermediate member.

In one example, the intermediate member comprises a plurality of protrusions and a plurality of recesses and is coupled to the support member at a tangent of each protrusion, and the liner member is coupled to the intermediate member at a tangent of each recess and defines a combustion chamber of the combustor. In one variation, the intermediate member comprises a corrugated metal and the protrusions are defined by a plurality of corrugations of the metal which protrude radially and distally from a centerline of the combustor.

In one example, the intermediate member is configured to expand between the support member and the liner member during combustion within the combustor.

In one example, the first gas passage is parallel to the second gas passage.

In one example, the at least a portion of gas flowing through the first gas passage flows into the second gas passage.

In one example, the intermediate member is coupled to the support member and to the liner member.

In one example, the support member comprises a first plurality of apertures to receive a first cooling gas flow, and the intermediate member comprises a second plurality of apertures to receive a second cooling gas flow comprising at least a portion of the first cooling gas flow.

In one variation of the previous example, the liner member comprises a plurality of tiles defining open passages therebetween to receive at least a portion of the second cooling gas flow therethrough.

In one variation of the previous example, each of the first plurality of apertures has a diameter greater than a diameter of each of the second plurality of apertures.

In one variation of the previous example, the second plurality of apertures control gas flow through the liner assembly.

In one variation of the previous example, a portion of the intermediate member which includes the first plurality of apertures is spaced apart from the liner member and the support member.

In one variation of the previous example, the diameter of each of the first plurality of apertures is between 0.050-0.300 inches and the diameter of each of the second plurality of apertures is between 0.020-0.050 inches.

In one variation of the previous example, the second plurality of apertures is longitudinally offset from the first plurality of apertures.

In one variation of the previous example, the intermediate member is coupled to the support member at a position inward of the first plurality of apertures and the intermediate member is coupled to the liner member at a position inward of the second plurality of apertures.

While the invention herein disclosed has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A liner assembly for a combustor, comprising:

a support member;

an intermediate member having a plurality of protrusions and a plurality of recesses, each of the plurality of protrusions circumferentially alternating with each of the plurality of recesses, the intermediate member being coupled to the support member at a tangent of each of the plurality of protrusions, wherein the tangent is located at the most radially distal point, from a centerline of the liner assembly, of each of the plurality of protrusions; and a liner member comprised of a plurality of tiles spaced apart by open passages and supported by the intermediate member, each of the plurality of tiles comprised of a ceramic matrix composite material, the liner member being coupled to the intermediate member at a tangent of each of the plurality of recesses and defining a combustion chamber of the combustor, wherein the tangent is located at the most radially proximal point, from the centerline, of each of the plurality of recesses, wherein the intermediate member is positioned intermediate the support member and the liner member and includes a plurality of apertures, wherein the plurality of apertures are spaced apart from the support member, and wherein each of the plurality of apertures is radially between the plurality of protrusions and the plurality of recesses.

2. The liner assembly of claim 1, wherein the intermediate member comprises a corrugated metal and the plurality of protrusions are defined by a plurality of corrugations of the corrugated metal which protrude radially and distally relative to the centerline of the liner assembly.

3. The liner assembly of claim 1, wherein the support member with the intermediate member define a first passage and the intermediate member with the liner member define a second passage.

4. The liner assembly of claim 3, wherein the support member includes a plurality of apertures permitting flow of a gas into the first passage and the plurality of apertures of the intermediate member permit flow of the gas into the second passage.

5. The liner assembly of claim 4, wherein the plurality of apertures of the intermediate member have smaller flow areas than that of the plurality of apertures of the support member and thus control flow of the gas from the second passage towards the liner member.

6. The liner assembly of claim 1, wherein a portion of the intermediate member which includes the plurality of apertures is spaced apart from the liner member and the support member.

7. The liner assembly of claim 1, wherein the intermediate member is configured to expand between the support member and the liner member during combustion within the combustor.

8. The liner assembly of claim 1, wherein the intermediate member and the support member are comprised of a metallic material.

9. The liner assembly of claim 1, wherein the intermediate member comprises an extension between each of the plurality of protrusions and each adjacent one of the plurality of recesses, and wherein each of the plurality of apertures is disposed in one of the extensions and does not abut the liner member nor the support member.

10. A liner assembly for a combustor, comprising:

a support member;

an intermediate member having a first surface facing the support member and a second surface opposite the first surface, wherein the intermediate member comprises a plurality of protrusions and a plurality of recesses, each of the plurality of protrusions circumferentially alternating with each of the plurality of recesses, the intermediate member supported by the support member at the most radially distal point, from a centerline of the liner assembly, of each of the plurality of protrusions;

a liner member comprised of a plurality of tiles spaced apart by open passages and supported by the intermediate member at the most radially proximal point, from the centerline, of each of the plurality of recesses, each of the plurality of tiles comprised of a ceramic matrix composite material, wherein the intermediate member is positioned intermediate the support member and the liner member, wherein the liner member defines a combustion chamber of the combustor;

a first gas passage positioned along the first surface of the intermediate member; and a second gas passage positioned along the second surface of the intermediate member, wherein the intermediate member comprises a plurality of apertures to direct at least a portion of a first cooling gas flowing through the first gas passage into the second gas passage, and the open passages allow the portion of the first cooling gas flowing through the second gas passage to flow into the combustion chamber, wherein the plurality of apertures are spaced apart from the support member, and wherein each of the plurality of apertures is radially between the plurality of protrusions and the plurality of recesses.

11. The liner assembly of claim 10, wherein the first gas passage is parallel to the second gas passage.

12. The liner assembly of claim 10, wherein the plurality of apertures in the intermediate member control the first cooling gas flow through the liner assembly.

13. The liner assembly of claim 9, wherein the support member includes a plurality of apertures for receiving the first cooling gas into the first gas passage.

14. The liner assembly of claim 9, wherein the intermediate member is coupled to the support member and to the liner member.

15. The liner assembly of dam 10, wherein the intermediate member has a coefficient of thermal expansion 2-4 times greater than the coefficient of thermal expansion of the liner member.

16. A liner assembly for a combustor, comprising:

a support member including a first plurality of apertures;

an intermediate member including a second plurality of apertures spaced apart from the support member, wherein the intermediate member comprises a plurality of protrusions and a plurality of recesses, each of the plurality of protrusions circumferentially alternating with each of the plurality of recesses, the intermediate member supported by the support member at the most radially distal point, from a centerline of the liner assembly, of each of the plurality of protrusions, wherein each of the second plurality of apertures is radially between the plurality of protrusions and the plurality of recesses; and a liner member comprised of a plurality of tiles spaced apart by open passages and supported by the intermediate member at the most radially proximal point, from the centerline, of each of the plurality of recesses, each of the plurality of tiles comprised of a ceramic matrix composite material, wherein the liner member defines a combustion chamber of the combustor, wherein the intermediate member is positioned intermediate the support member and the liner member.

17. The liner assembly of claim 16, wherein each of the first plurality of apertures has a diameter greater than a diameter of each of the second plurality of apertures.

18. The liner assembly of claim 17, wherein the diameter of each of the first plurality of apertures is between 0.050-0.300 inches and the diameter of each of the second plurality of apertures is between 0.020-0.050 inches.

19. The liner assembly of claim 16, wherein cooling gas is received through the first plurality of apertures and flows through the second plurality of apertures, and wherein the open passages allow the cooling gas flowing through the second plurality of apertures to flow into the combustion chamber.

20. The liner assembly of claim 18, wherein the second plurality of apertures is longitudinally offset from the first plurality of apertures relative to the centerline.

* * * * *